United States Patent [19]

Seldner

[11] 4,179,327

[45] Dec. 18, 1979

[54] PROCESS FOR COATING PYROTECHNIC MATERIALS

[75] Inventor: Alvin A. Seldner, Saugus, Calif.

[73] Assignee: Allied Chemical Corporation, Morris Township, Morris County, N.J.

[21] Appl. No.: 924,262

[22] Filed: Jul. 13, 1978

[51] Int. Cl.[2] ..... C23F 1/00

[52] U.S. Cl. ..... 156/667; 149/3; 252/79.1; 427/215; 427/309

[58] Field of Search ..... 427/307, 309, 212, 215; 149/2, 3; 102/99, 104; 156/625, 626, 667, 668; 252/79.1

[56] References Cited

U.S. PATENT DOCUMENTS

| | | | |
|---|---|---|---|
| 2,070,359 | 2/1937 | Hillers | 427/309 X |
| 2,989,389 | 6/1961 | Prior et al. | 427/215 X |
| 4,092,187 | 5/1978 | Hidebrant et al. | 427/215 X |

*Primary Examiner*—William A. Powell
*Attorney, Agent, or Firm*—Roger H. Criss

[57] ABSTRACT

A method for preparing the surface of pyrotechnic propellant compositions for coating by emersing said compositions in an aqueous/alcohol solution.

8 Claims, No Drawings

PROCESS FOR COATING PYROTECHNIC MATERIALS

BACKGROUND OF THE INVENTION

1. Field of the Invention

This invention relates to a method for preparing the surface of a pyrotechnic composition for coating, especially those propellants suitable for use in inflating an inflatable device, such as a vehicle safety restraint.

2. Description of the Prior Art

Various pyrotechnic propellants have been prepared for generating a gas upon combustion in order to inflate an air bag or similar safety restraint in a vehicle so as to restrain movement of an occupant in the event of a sudden deceleration of the vehicle, such as caused by collision. In order to be employed as a pyrotechnic gas generating composition for inflatable occupant restraints, several criteria must be met. The pyrotechnic must be capable of producing non-toxic, non-flammable and essentially smokeless gases over a wide variety of temperatures and other environmental conditions. The gases that are generated must be totally ignited at a sufficiently low temperature so as not to destroy the restraint or injure the occupant. The pyrotechnic must also be safe to handle and must be capable of generating a substantial amount of gas within a very short period of time, e.g., less than about 100 milliseconds.

In order to achieve total ignition and combustion of the pyrotechnic formulation, various ignition enhancers can be used. Although the ignition enhancer can be admixed with the pyrotechnic material before the material is pressed into pellets it is preferred to first prepare the pyrotechnic pellets and subsequently apply the ignition enhancer as a coating. See for example co-filed application entitled, Ignition Enhancer Coating Compositions For Pyrotechnic Propellants, Inventors E. F. Garner and B. K. Hamilton, Attorney's Docket No. 2000-610, and incorporated herein by reference.

An ignition enhancer coating mix, and techniques for its application, require the solution of several problems, one of which is providing adequate adhesion of the coating to the propellant surface so that the coating can withstand the rigors of an automobile environment. In general, adhesion of the coating to the pellet can be a problem owing to the fact that the pyrotechnic propellant material is formulated from a variety of materials and mixed with a pressing aid such as Teflon, stearic acid, etc. These materials and pressing aids can have a slick deposit on the surface of the pellet, thereby making the application of a coating difficult.

SUMMARY OF THE INVENTION

In accordance with the present invention, there is provided a method for preparing the surface of pyrotechnic propellant compositions by etching prior to applying an ignition enhancer coating thereto. The etched surface provides good adhesion of the coating to the propellant. The method comprises emerging the pressed propellant, preferably in pellet form, in a solution comprised of about 1 to 10 vol. % water, preferably about 2 to 4 vol. % and 99 to 90 vol. % of a $C_1$ to $C_4$ aliphatic alcohol for a time sufficient enough to etch the surface of the propellant.

DESCRIPTION OF THE PREFERRED EMBODIMENT

Pyrotechnic compositions for which the presently claimed invention is suitable for use are any of those pyrotechnic compositions generally known in the art. Such pyrotechnic compositions generate a gas upon combustion and are generally comprised of mixtures of chemical components such as fuels, oxidizers, nitrogen generating compounds, coolants, and other propellant adjuvants. These compositions are capable of being activated by, for example, an electrically energized squib to generate substantial volumes of gas for inflating such devices as automobile crash bags.

Non-limiting examples of nitrogen generating compounds are the alkali and alkaline earth metal azides such as lithium azide, sodium azide, potassium azide, rubidium azide, cesium azide, calcium azide, magnesium azide, strontium azide and berium azide.

Oxidizing compounds suitable for use in pyrotechnic compositions include metal peroxides such as sodium peroxide, potassium peroxide, rubidium peroxide, cesium peroxide, calcium peroxide, strontium peroxide, and varium peroxide; inorganic chlorate such as sodium chlorate, potassium chlorate, lithium chlorate, rubidium chlorate, magnesium chlorate, strontium chlorate, barium chlorate; inorganic perchlorate, such as lithium perchlorate, sodium perchlorate, potassium perchlorate, rubidium perchlorate, magnesium perchlorate, calcium perchlorate, strontium perchlorate, barium perchlorate, ferric perchlorate, and cobalt perchlorate; and metal nitrates such as lithium nitrate, sodium nitrate, potassium nitrate, copper nitrate, silver nitrate, magnesium nitrate, barium nitrate, zinc nitrate, aluminum nitrate, thallium nitrate, stannic nitrate, bismuth nitrate, manganese nitrate, ferric nitrate, ferrous nitrate and nickel nitrate. Also suitable for use are ammonium perchlorate, ammonium nitrate, and the like.

Non-limiting examples of fuels suitable for use in pyrotechnic compositions are oxygen containing metal compounds generally used in combination with an oxidizer to produce carbon dioxide. Illustrative of such compounds are aluminum acetate, aluminun citrate, barium formate, barium acetate, barium citrate, barium butyrate, barium malonate, barium propionate, barium succinate, cadmium formate, cadmium acetate, cadmium lactate, calcium formate, calcium acetate, calcium citrate, calcium tartrate, calcium lactate, calcium benzoate, calcium salicylate, cerous acetate, cesium acid tartrate, chromic acetate, cobaltous acetate, columbium acid oxalate, cupric formate, cupric acetate, dysprosium acetate, erbium acetate, ferric acetate, ferrous formate, ferrous acetate, ferrous tartrate, ferrous lactate, gadolinium acetate, lead formate, lead acetate, lithium formate, lithium acetate, lithium citrate, lithium acid oxalate, lithium benzoate, lithium salicylate, magnesium formate, magnesium acetate, magnesium citrate, magnesium tartrate, magnesium benzoate, manganese formate, manganese acetate, manganese lactate, manganese benzoate, nickel formate, nickel acetate, potassium formate, potassium acetate, potassium acid acetrate, potassium citrate, potassium tartrate, potassium acid tartrate, potassium acid oxalate, potassium benzoate, potassium acid phthalate, samarium formate, samarium acetate, silver acetate, silver citrate, silver tartrate, sodium formate, sodium acetate, sodium citrate, sodium tartrate, sodium acid tartrate, sodium acid oxalate, sodium salicylate, sodium methylate, strontium formate, strontium acetate, strontium tartrate, strontium lactate, strontium salicylate, thallium acetate, ytterbium acetate, zinc formate, and zinc acetate also; aluminum citrate, barium formate, barium citrate, calcium formate, calcium citrate, calcium acid tartrate, chromic acetate, cupric formate, ferrous tartrate, lithium formate, lithium acid oxalate, lithium citrate, magnesium formate, magnesium citrate, magnesium tartrate, manganese formate, nickel formate, potassium formate, potassium acid oxalate, potassium citrate, potassium tartrate, potassium acid tartrate, silver citrate, silver tartrate, sodium formate, sodium acid oxalate, sodium citrate, sodium tartrate, sodium acid tartrate, strontium formate, strontium tartrate, zinc formate and zinc oxalate.

Other compounds suitable for contributing oxygen are transition metal oxides such as iron oxide, copper oxide, manganese oxide, titanium oxide and vanadium oxide; preferred are ferric oxide, ferrous oxide and copper oxide, more preferred is ferric oxide.

Alcohols suitable for use in the etching solution of the present invention are the $C_1$ to $C_4$ aliphatic alcohols. Non-limiting examples of such alcohols include methanol, ethanol, propanol, butanol, isopropanol, etc.

The method used to determine whether the surface of the pyrotechnic pellets were adequately etched was to visually examine the surface of the pellet before and after etching. The surface of the pellet appears shiny before etching whereas after adequate etching the surface of the pellet appears hazy or dull. The length of time for which the pellets are left in solution is an effective amount of time needed to turn the surface of the pellet from a shiny appearance to a hazy appearance, but not for too long a length of time wherein water will penetrate the pellet and adversely affect the pyrotechnic properties of the pellet. Generally, an effective length of time is about 0.5 to 5 seconds for a solution at room temperature (about 65° to 75° F.).

After the surface of the pyrotechnic propellant has been etched, it can be coated by any conventially accepted coating method known in the art. One such method comprises dissolving an oxygen-containing polymeric fuel in an appropriate solvent such as methylene chloride in a mixing vessel such as a ball-mill jar. An inorganic oxidizer and an alkali metal azide are placed in the jar, along with the grinding-balls. The jar is placed on a ball-mill for a time sufficient to form a suspension—generally up to about 12 hours. The propellant to be coated, in coated form, is placed in an appropriate container such as a stainless steel mesh basket and dipped into the coating mix with agitation for a time sufficient to completely coat the propellant pellets—generally about minutes. The basket is then withdrawn from the mix and suspended over the solution to drip and slightly dry for about 10 to 20 seconds. The coated pellets are then baked in an oven at about 120° to 200° C., preferably 140 ° to 160° C. for 0.5 to 2 hours, preferably 0.75 to 1.25 hours.

In order to further describe the present invention, the following non-limiting examples are given.

EXAMPLE I

A pyrotechnic composition consisting of 8.54 wt. % of an acetal copolymer having a melt index of 9 (sold under the designation "Celcon"), 2.83 wt. % carbon black, 45.5 wt. % sodium chlorate, 20.8 wt. % calcium sulfate sesquihydrate, and 22.3 wt. % aluminum hydroxide is initimately mixed by ball-milling under methylene chloride, dried, and pressed into pellets with the use of a pressing and ingredient such as Teflon. The aforementioned weight percents are based on the total weight of the pyrotechnic pellet.

The surface of the pellets after visual inspection is found to be shiny and slick. These pellets are coated with an ignition enhancer composition consisting of 10 wt. % polyvinyl acetate, 4 wt. % of finely ground (20μ), 80 wt. % potassium perchlorate, 1 wt. % carbon black and 5 wt. % ferric oxide, wherein these weight percents are based on the total weight of the coating composition.

The coating on many of these pellets is found to peel and thereby indicates relatively low adhesion value of the coating to the pellets.

EXAMPLE II

Example I is repeated except that before the pellets are coated with ignition enhancer they are etched in a solution comprised of 87 volume percent ethyl alcohol and 3 volume percent water for a time sufficient to etch the surface of the pellets but not to allow absorbtion of the solution into the pellet—about 1 second.

On visual inspection, the surface of the pellets after etching, are found to have a hazy appearance. The resulting coated pellets are found to have good adhesion of the coating to the pellet without evidence of peeling.

It is to be understood that variations and modifications of the present invention may be made without departing from the scope thereof. It is also understood that the present invention is not to be limited by the specific embodiments disclosed herein but only in accordance with the appended claims when read in light of the foregoing specification.

What is claimed is:

1. A method of treating the surface of a pyrotechnic propellant material prior to application of a coating on said material which comprises etching the surface of the material with a solution comprised of about 1 to 10 vol. % water and 99 to 90 vol. % of a $C_1$ to $C_4$ aliphatic alcohol for an effective amount of time.

2. The method of claim 1 wherein the $C_1$ to $C_4$ alcohol is selected from the group consisting of methanol, ethanol, and isopropanol.

3. The method of claim 2 wherein the solution consists of about 2 to 4 vol. % water and 98 to 96 vol. % alcohol.

4. The method of claim 3 wherein the pyrotechnic propellant is in pellet form.

5. The method of claim 1 wherein the pyrotechnic material is comprised of an inorganic oxidizer, an oxygen-containing polymeric compound, and a coolant.

6. The method of claim 5 wherein the inorganic oxidizer is sodium chlorate, the oxygen-containing polymeric compound is a polyacetal resin, and the coolant is calcium hydroxide.

7. The method of claim 1 wherein the pyrotechnic material is comprised of an alkali or alkaline earth metal azide and a metal oxide.

8. The method of claim 7 wherein the alkali-metal azide is sodium azide and the metal oxide is iron oxide.

* * * * *